US006910317B2

(12) United States Patent
Suzuki et al.

(10) Patent No.: US 6,910,317 B2
(45) Date of Patent: Jun. 28, 2005

(54) SYSTEM FOR SEALING AMPOULES WITH A SAMPLE HOUSED THEREIN, IN DRY FASHION

(75) Inventors: Ken-ichiro Suzuki, Tokyo (JP); Sugao Kato, Tokyo (JP); Kenzo Takagi, 11-6, Minami oi 1-chome, Shinagawa-ku, Tokyo (JP)

(73) Assignee: Kenzo Takagi, Tokyo (JP)

( * ) Notice: Subject to any disclaimer, the term of this patent is extended or adjusted under 35 U.S.C. 154(b) by 0 days.

(21) Appl. No.: 10/386,573

(22) Filed: Mar. 13, 2003

(65) Prior Publication Data

US 2003/0172628 A1 Sep. 18, 2003

(30) Foreign Application Priority Data

Mar. 15, 2002 (JP) ..... 2002-071718

(51) Int. Cl.[7] ..... B65B 31/02
(52) U.S. Cl. ..... 53/510; 53/284.6; 53/89
(58) Field of Search ..... 53/403, 408, 432, 53/443, 444, 467, 477, 484, 79, 86, 89, 90, 97, 110, 111 R, 510, 122, 127, 284.6

(56) References Cited

U.S. PATENT DOCUMENTS 4,096,683 A * 6/1978 McMickle, Jr. ..... 53/244
4,785,608 A * 11/1988 Debnam et al. ..... 53/432
5,390,469 A * 2/1995 Shimizu et al. ..... 53/53
6,164,044 A * 12/2000 Porfano et al. ..... 53/471
6,189,292 B1 * 2/2001 Odell et al. ..... 53/425
6,250,052 B1 * 6/2001 Porfano et al. ..... 53/471
6,263,641 B1 * 7/2001 Odell et al. ..... 53/425
RE37,471 E * 12/2001 Jagger ..... 53/282
6,619,016 B1 * 9/2003 Sindermann et al. ..... 53/432
6,722,054 B2 * 4/2004 Yarborough et al. ..... 34/284

* cited by examiner

*Primary Examiner*—Stephen F. Gerrity
*Assistant Examiner*—Christopher Harmon
(74) *Attorney, Agent, or Firm*—Oblon, Spivak, McClelland, Maier & Neustadt, P.C.

(57) ABSTRACT

In an airtight chamber in an atmosphere under a desired degree of evacuation to be generated by use of a vacuum pump, there are provided an ampoule holder, which can hold at an upright position, a plurality of ampoules with an open upper portion faced upward, a stage for putting the ampoule holder thereon, a melt-sealing unit for the upper portion of each of the ampoules, and a transfer unit, which catches an ampoule held in the ampoule holder, transfers the ampoule to the melt-sealing unit, catches again the ampoule melt-sealed by the melt-sealing unit and transfers the melt-sealed ampoule to the ampoule holder to hold the ampoule therein. The ampoule holder and the stage are made of metal having a good thermal conduction. There is provided a temperature controller for the stage.

6 Claims, 11 Drawing Sheets

SYSTEM FOR SEALING AMPOULES WITH A SAMPLE HOUSED THEREIN, IN DRY FASHION

CROSS-REFERENCE TO RELATED APPLICATIONS

The present application claims a priority under 35 U.S.C. §119 to Japanese Patent Application No. 2002-071718, filed on Mar. 15, 2002 and entitled "SYSTEM FOR SEALING AMPOULES WITH A SAMPLE HOUSED THEREIN, IN DRY FASHION". The contents of the application are incorporated herein by reference in their entirety.

BACKGROUND OF THE INVENTION

1. Field of the Invention

The present invention relates to a system for melt-sealing glass ampoules with a microorganism containing sample housed therein at a desired temperature and in an atmosphere under a desired degree of evacuation in such a state that the sample has a moisture content thereof lowered.

2. Discussion of Background

Glass ampoules have been used as containers for storing a sample, which contain a microorganism to be utilized for various kinds of tests, researches and other purposes.

For the purpose of sealing that sort of sample in an ampoule, there has been a method wherein the ampoule is immersed in a bath with liquid nitrogen or the like filled therein to be stored in a frozen state. However, it is difficult to reduce the installation costs and the running costs of the storing equipment in this method.

From this viewpoint, there has been used a method wherein that sort of sample is stored by melt-sealing an ampoule with the sample therein while evacuating the ampoule to decrease the moisture content of the sample.

However, it has been not easy to carry out the evacuation treatment for each ampoule.

Additionally, the sealing operation for that sort of ampoules has been carried out by heating and melting an upper open portion of each ampoule by use of a burner or the like with the ampoule being evacuated as stated earlier. It is not easy to carry out this sealing operation.

The evacuation treatment creates a drop in the boiling point of the sample housed in an ampoule. In order to cope with this problem, it is necessary to decrease the temperature of the ampoule, depending on the degree of evacuation, until the moisture content of the sample housed in the ampoule has reached a desired moisture content. However, it has been unavoidable to carry out the evacuation treatment with the sample being frozen at a temperature lower than needed, since the temperature of the sample housed in the ampoule is gradually increasing until the moisture content of the sample housed in the ampoule has reached the desired moisture content. Normally, that sort of samples have been frozen at as low a temperature as minus 80 degrees Celsius.

There has been also a treatment wherein the moisture content is decreased by gradually increasing the degree of evacuation in the ampoule without freezing the sample (so-called "L-dry"). However, it has not been possible to completely deny the possibility that the microorganism contained in the sample could be adversely affected by temperature changes until the treatment has been completed, since there have been no specific measures to keep the temperature of the ampoule constant until completion of the treatment.

SUMMARY OF THE INVENTION

It is a main object of the present invention to sequentially and properly melt-seal glass ampoules with a microorganism containing sample housed therein, in an atmosphere under a desired degree of evacuation in such a state that the ampoules are put together at a desired temperature, and the sample has a moisture content thereof lowered in the atmosphere.

In order to attain the object, according to a first aspect of the present invention, there is provided a system for sealing a plurality of ampoules with a sample housed therein, in dry fashion, which has the following features 1) to 6):

1) the system capable of melt-sealing glass ampoules with a microorganism containing sample housed therein, putting the ampoules at a desired temperature and in an atmosphere under a desired degree of evacuation so that the sample has a moisture content thereof lowered in the atmosphere, comprising:

2) an airtight chamber, which has an opening formed so as to be closable in airtight fashion by an openable and closable cover; and 3) a vacuum pump, which can bring the airtight chamber into the atmosphere under the desired degree of evacuation.

4) the airtight chamber including:

an ampoule holder, which can hold the ampoules in an upright position so that an open upper portion of each of the ampoules faces upward;

a stage, on which the ampoule holder is put;

a melt-sealing unit for the upper portion of each of the ampoules; and a transfer unit, which catches an ampoule held in the ampoule holder and transfers the ampoule to the melt-sealing unit, and which catches the ampoule melt-sealed at the melt-sealing unit and transfers the melt-sealed ampoule to the ampoule holder to be held therein;

5) the ampoule holder and the stage being made of metal having a good thermal conduction; and 6) a temperature controller for the stage.

By this arrangement;

1) First, the plural ampoules, which have preliminarily had the respective samples housed therein, can be accommodated together into the airtight chamber by the ampoule holder.

2) Second, the airtight chamber with the plural ampoules accommodated therein can be brought into airtight fashion by closing the cover. Additionally, the ampoules held in the ampoule holder, i.e., the samples can be put at a desired temperature by carrying out heat exchange between the stage and the ampoule holder on the stage while controlling the temperature of the stage by use of the temperature controller.

In accordance with the system, the sample housed in each of the ampoules can be maintained at a temperature without a boil, depending on the degree of evacuation in the airtight chamber, until the moisture content of the sample has reached to the desired value.

The sample in each of the ampoules may be frozen. After the moisture content of the frozen sample has reached to the desired value that creates no trouble caused by a boil, the sample may be heated to accelerate drying of the sample.

When the so-called "L-dry" is carried out, the samples housed in the ampoules can be kept at a temperature appropriate to the bacteria contained in the samples until the moisture content of each of the samples has reached to the desired value.

3) Additionally, the airtight chamber can be brought into the desired degree of evacuation by the vacuum pump to lower the moisture content of the samples to the desired value.

4) After that, the ampoules held in the ampoule holder can be transferred to the melt-sealing unit at least one by one by the transfer unit, and the ampoules can have the open upper portion melt-sealed in the airtight chamber, which is maintained in the atmosphere under the desired degree of evacuation.

5) Additionally, the transfer unit can bring the melt-sealed ampoules back to the ampoule holder to hold the ampoules at the upright position. All ampoules held in the ampoule holder can be sequentially melt-sealed in the airtight chamber.

6) After the melt-sealing operation for all ampoules held in the ampoule holder has been completed, the melt-sealed ampoules can be moved together outside the system for storage or another purpose by opening the cover for closing the opening of the airtight chamber and taking out the ampoule holder through the opened opening.

According to a second aspect of the present invention, it is characterized in that the ampoule holder referred to in the first aspect is provided as a board, which has a plurality of holes formed on an upper portion so as to receive the ampoules.

By this arrangement, the ampoules can be held together in an upright position by having lower portions of the respective ampoules into the respective holes in the ampoule holder.

According to a third aspect of the present invention, it is characterized in that the stage referred to in the first aspect or the second aspect includes a duct for a coolant or a heat transfer medium formed therein, and that the temperature controller comprises a heat exchanger to circulate the coolant or the heat transfer medium through the duct.

By this arrangement, it is possible to heat or cool the stage to a desired temperature and also to control the temperature.

According to a fourth aspect of the present invention, it is characterized in that the transfer unit referred to in the first aspect, the second aspect or the third aspect includes:

a stage moving device, which linearly reciprocates the stage in a horizontal direction;

a head moving device, which linearly reciprocates a head above the stage in the horizontal direction and in a direction substantially perpendicular to a moving direction of the stage, the head having a lower end provided with a chuck for an ampoule; and a lifting device for the chuck, which is provided on the head to move the chuck vertically.

In this arrangement, by moving the stage, the head and the chuck by use of respective servomotors, the head is moved to just above the ampoule at a location in the ampoule holder, the chuck is lowered to catch the ampoule, the chuck is lifted to take the ampoule out of the ampoule holder, and the ampoule is transferred to the melt-sealing unit.

After the head is moved to just above the ampoule melt-sealed by the melt-sealing unit, the chuck is lowered to catch the ampoule, the chuck is lifted, the ampoule is transferred from the melt-sealing unit back to the ampoule holder, and the ampoule is held at an upright position in the ampoule holder. In the other words, the ampoule is typically returned to its own original location, where the ampoule has been held.

By repeating the transference to the melt-sealing unit, the melt-sealing operation and the transference from the melt-sealing unit to the ampoule holder, all ampoules held in the ampoule holder can be melt-sealed.

According to a fifth aspect of the present invention, it is characterized in that the melt-sealing unit for an ampoule referred to in the first aspect, the second aspect, the third aspect or the fourth aspect includes:

a holding device, which can hold an ampoule transferred by the transfer unit at an upright position with the open upper portion faced upward;

a heater for heating the upper portion of an ampoule; and a sandwiching and sealing device for the upper portion of a heated ampoule;

wherein the sandwiching and sealing device is located on a lateral side of the upper portion of the ampoule held in the holding device, and the heater is located above the upper portion of the held ampoule.

the holding device includes:

a supporter, into which an ampoule is inserted from above;

an urging device, which constantly urges the supporter; and an extruding shaft, which is pressed against a lower portion of the supporter from below so as to be able to upwardly move the supporter against an urging action of the urging device;

wherein the upper portion of the ampoule is heated by the heater with the supporter pushed up by the extruding shaft, the extruding shaft ceases to push up the supporter after heating, the supporter is lowered to its original position by the urging action of the urging device, and the upper portion of the heated ampoule is sandwiched and sealed by the sandwiching and sealing device.

By this arrangement;

1) First, the ampoule, which has been transferred to just above the supporter by the transfer unit, is inserted into the supporter from above, and the ampoule can be held in an upright position in the melt-sealing unit by the supporter.

2) Next, the supporter with the ampoule held therein is pushed up by the extruding shaft, the upper portion of the ampoule is heated and melted, the extruding shaft ceases to push up the supporter on completion of the heating and melting operation and allows the supporter to be lowered under the urging action of the urging device, and the melted upper portion of the ampoule held by the supporter is located at a lateral position of the sandwiching and sealing device.

3) Finally, the melted upper portion of the ampoule is smoothly sealed, being sandwiched by the sandwiching and sealing device.

According to a sixth aspect of the present invention, it is characterized in that the holding device includes supporters provided at opposite positions on a turntable with respect to a rotary shaft of the turntable so that the heater and the sandwich and sealing device can be located above one of the paired supporters.

By this arrangement, during the time period when a second unsealed ampoule at a second place is being subjected to the heating operation and the sealing operation, the turntable can carry out the move of the melt-sealed ampoule at a first place to the ampoule holder and the move of the unsealed ampoule to be melt-sealed at a third place toward the melt-sealing unit, effectively melt-sealing the plural ampoules.

BRIEF DESCRIPTION OF THE DRAWING FIGURES

A more complete appreciation of the invention and many of the attendant advantages thereof will be readily obtained as the same becomes better understood by reference to the following detailed description when considered in connection with the accompanied drawings, wherein.

DETAILED DESCRIPTION OF THE PREFERRED EMBODIMENTS

Now, a typical embodiment of the present invention will be described in reference to FIG. 1 to FIG. 12.

Figure 6:
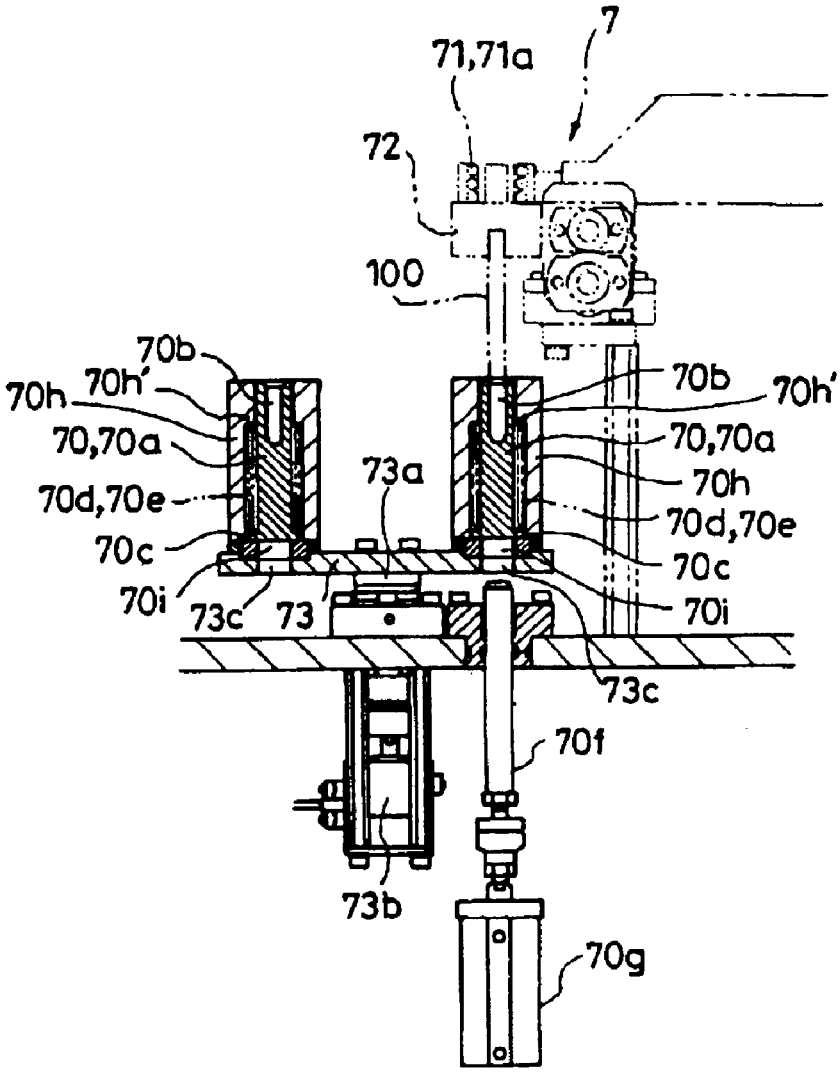
FIG. 6 is a schematic side view of a melt-sealing unit.
Figure 7:
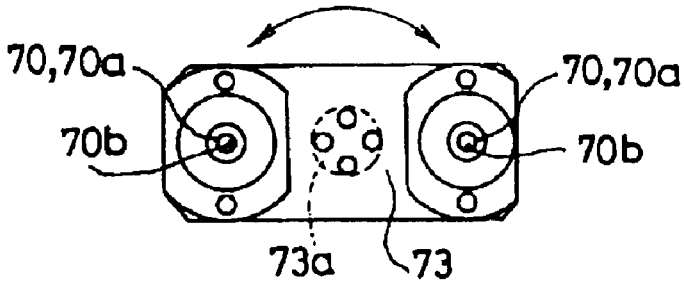
FIG. 7 is a schematic plan view of a turntable.
Figure 8:
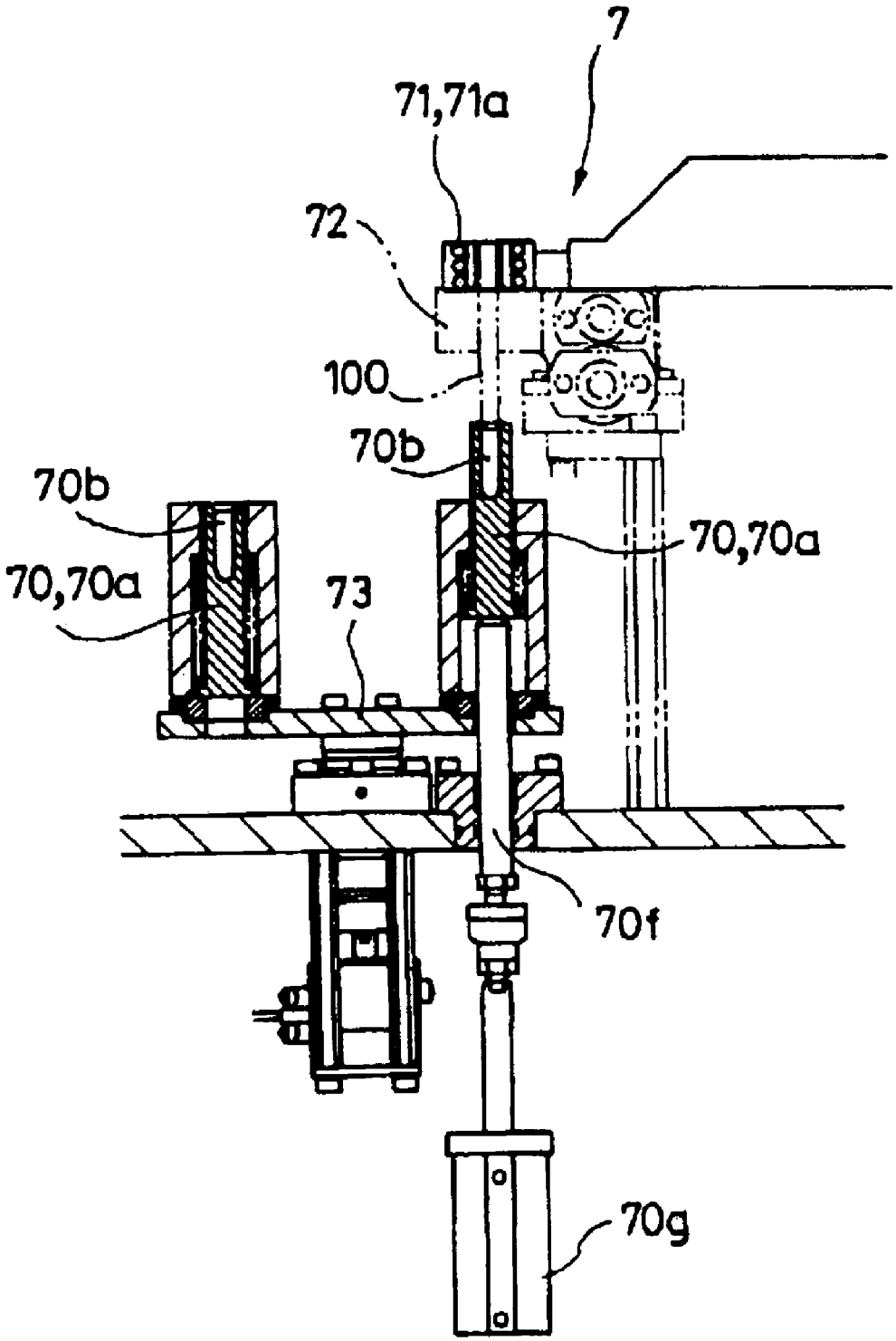
FIG. 8 is a schematic side view of the melt-sealing unit.
Figure 9:
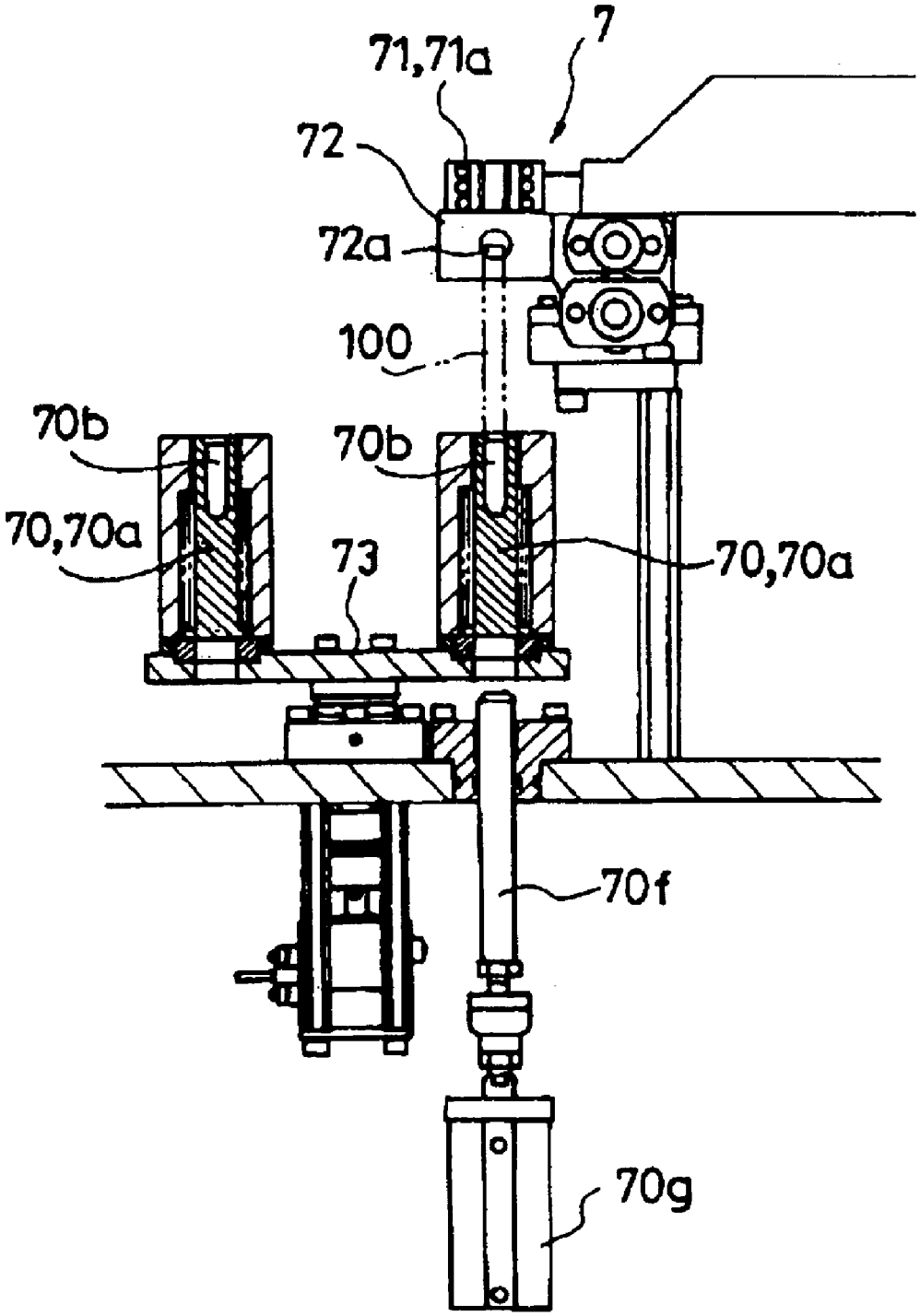
FIG. 9 is a schematic side view of the melt-sealing unit.
Figure 10:
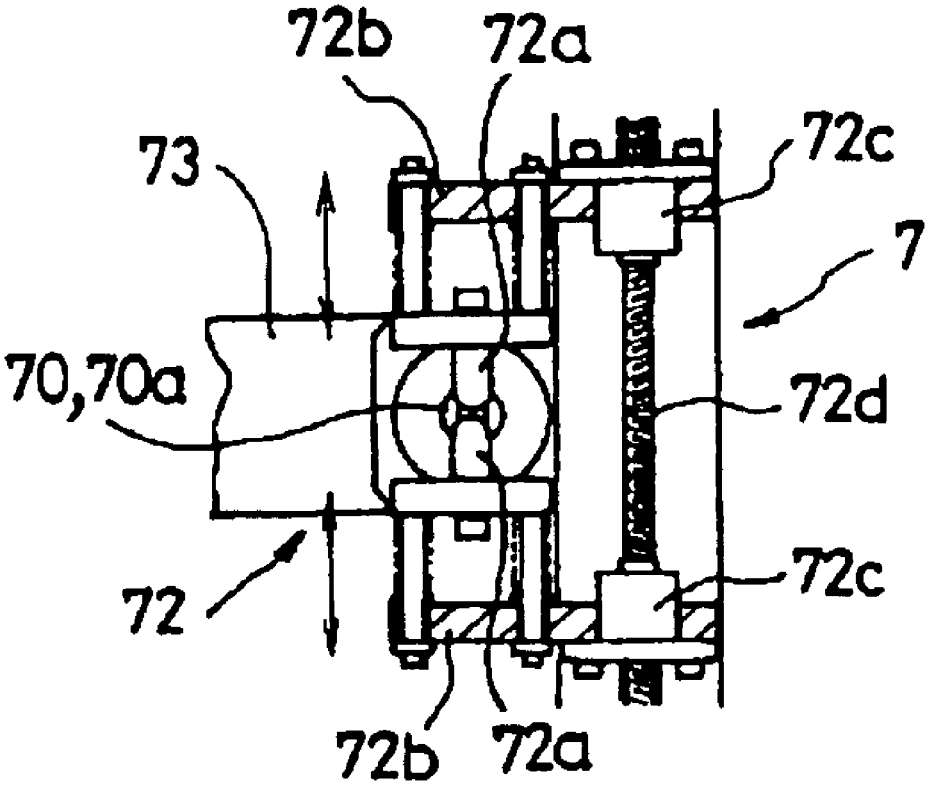
FIG. 10 is a schematic plan view of the melt-sealing unit.
Figure 11:
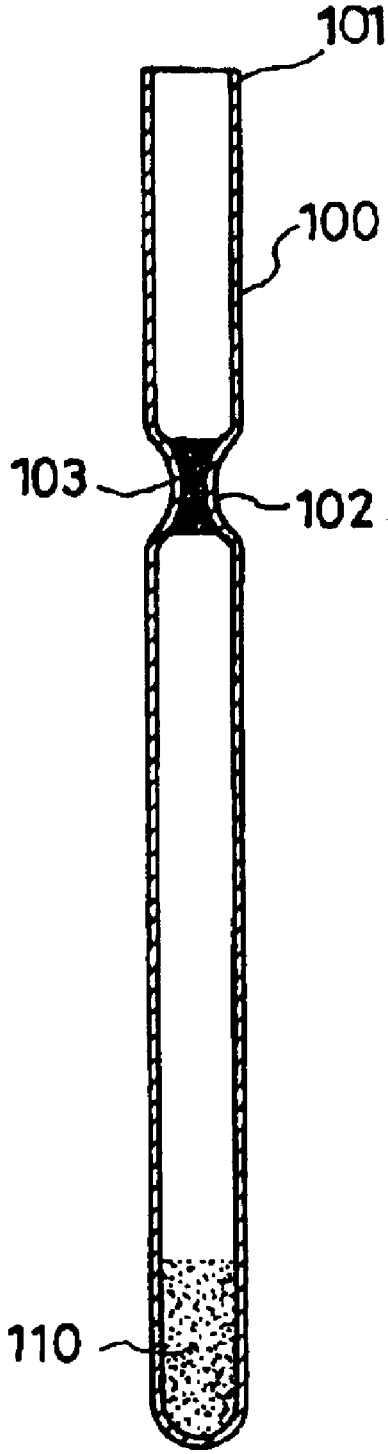
FIG. 11 is a schematic cross-sectional view of an ampoule with a sample housed therein.
Figure 12:
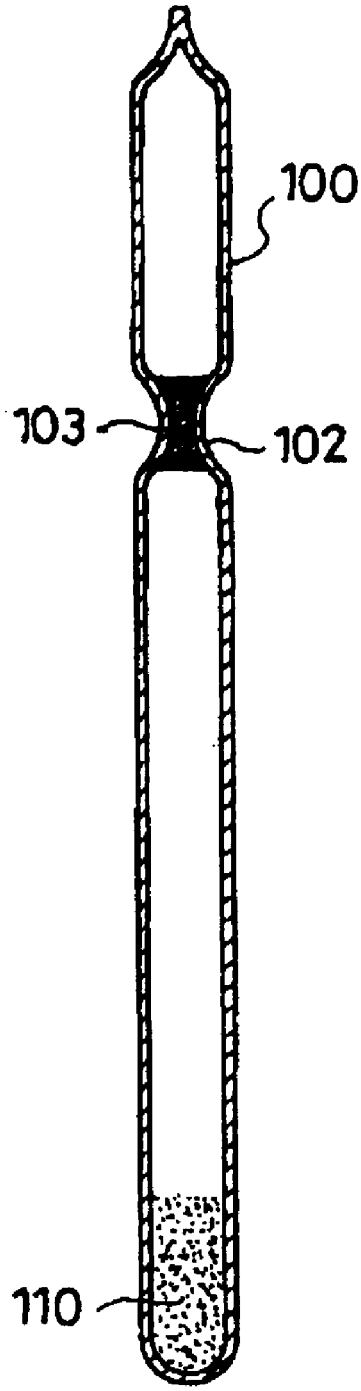
FIG. 12 is a schematic cross-sectional view of the ampoule with an upper portion sealed.

FIG. 1 to FIG. 5 are schematic views of the system according to the embodiment. FIG. 6, FIG. 8 and FIG. 9 are views of a melt-sealing unit 7 in the system, as viewed in a lateral direction of the unit. FIG. 7 is a view of a turntable 73 in the system, as viewed from above. FIG. 10 is a view of a sandwiching and sealing unit 72 and a portion of the turntable 73 forming the system, as viewed from above. In particular, FIG. 10 shows a state wherein a pair of sandwiching bars 72*a* and 72*a* forming a sandwiching and sealing unit 72 have moved to a position to sandwich an upper portion 101 of an ampoule 100. Additionally, FIG. 11 shows the ampoule 100 before sealing, and FIG. 12 shows the ampoule 100 having the upper portion 101 sealed by the system.

The system according to the embodiment is used to melt-seal glass ampoules 100 with a microorganism containing sample 110 housed therein in an atmosphere under a desired degree of evacuation in such a state that the ampoules are put at a desired temperature, and that the sample 110 has a moisture content thereof lowered in the atmosphere.

Microorganism

Examples of the microorganism to be contained in each of the samples are a protozoan, a fungus, a blue-green alga, a bacterium and a virus.

Ampoules 100

Typical examples of the ampoules 100 are glass tubes, which have the upper portion 101 opened and a lower portion closed. The ampoules 100 have a constricted portion 102 formed between the upper and lower portions. The ampoules have the sample 110 housed in a lower area than the constricted portion 102 by injection or another treatment. A cotton plug 103, which has a thickness enough to be caught in the constricted portion 102, is inserted in the constricted portion of each of the ampoules as required after the sample has been injected therein.

The system according to the embodiment is used to store the samples 110 stably for a long term by accommodating the ampoules with the sample 110 preliminarily housed therein, into an airtight chamber 2 stated later, then decreasing the moisture content of the samples to a desired value, and further melt-sealing the open upper portion 101 of each of the ampoules 100 in such a state that the ampoules, i.e., the samples 110 are put at a desired temperature in the airtight chamber 2.

Degree of Evacuation and Temperature

By bringing the atmosphere in the airtight chamber 2 with the ampoules 100 accommodated therein under the desired degree of evacuation, the moisture content of the sample housed in each of the ampoules 100 decreases.

Typically, the airtight chamber 2 is brought to be under an atmosphere under a degree of evacuation from $10^{-2}$ to $10^{-3}$ Pa after having accommodated the ampoules 100.

The ampoules 100 may be cooled, depending to the degree of evacuation in the airtight chamber 2, to such a temperature that the sample 110 in each of the ampoules 100 is not brought to a boil.

In a case wherein, in such a state that the samples 110 housed in the ampoules 100 are frozen, the degree of evacuation in the airtight chamber 2 is increased to lower the moisture content of each of the frozen samples 110, the ampoules 100 are heated to accelerate drying of the samples 110 after the moisture content of each of the frozen samples 110 has reached to the desired value that creates no trouble caused by a boil.

When the so-called "L-dry" is carried out, the samples 110 housed in the ampoules 100 are kept at a temperature appropriate to the bacteria contained in the samples 110 until the moisture content of each of the samples 110 has reached to the desired value.

Melt-Sealing of Ampoules 100

The melt-sealing of the open upper portion 101 of each of the ampoules 100 is carried out by heating each of the ampoules 100 to 1,000 to 1,200 degrees Celsius.

The heating operation may be typically carried out with a high-frequency heating unit since the melt-sealing operation for the ampoules 10 is carried out in the airtight chamber 2, which is maintained in the atmosphere under the desired degree of evacuation.

Schematic Structure of System

The system according to the embodiment comprises:

1) the airtight chamber 2, which has an opening 21 formed so as to be closable in airtight fashion by an openable and closable cover 20; and 2) a vacuum pump 3, which can bring the airtight chamber 2 into the atmosphere under the desired degree of evacuation.

Additionally, the airtight chamber 2 includes:

3) an ampoule holder 4, which can hold the plural ampoules 100 in an upright position so that the open upper portion 101 of each of the ampoules faces upward;

4) a stage 5, on which the ampoule holder 4 is put;

5) a melt-sealing unit 7 for the upper portion 101 of each of the ampoules 100; and 6) a transfer unit 8, which catches an ampoule 100 held in the ampoule holder 4 and transfers the ampoule to the melt-sealing unit 7, and which catches the ampoule 100 melt-sealed at the melt-sealing unit 7 and transfers the melt-sealed ampoule to the ampoule holder 4 to be held therein.

7) The ampoule holder 4 and the stage 5 are made of metal having a good thermal conduction.

8) There is provided a temperature controller 9 for the stage 5.

In accordance with the system having the features stated above, the following advantages are offered:

1) First, the plural ampoules 100, which have preliminarily had the respective samples 110 housed therein, can be accommodated together into the airtight chamber 2 by the ampoule holder 4. Specifically speaking, the plural ampoules 100 can be accommodated together into the airtight chamber 2 by holding the ampoules 100 at the upright position in the ampoule holder 4 outside the system, opening the cover 20 of the airtight chamber 2 to accommodate the ampoules holder 4 into the airtight chamber 2 through the opened opening 21, and putting the ampoules holder 4 onto the stage 5.

2) Second, the airtight chamber 2 with the plural ampoules 100 accommodated therein can be brought into airtight fashion by closing the cover 20. Additionally, the ampoules 100 held in the ampoule holder 4, i.e., the samples 110 can be put at the desired temperature by carrying out heat exchange between the stage 5 and the ampoule holder 4 on the stage while controlling the temperature of the stage 5 by use of the temperature controller 9.

In accordance with the system, the sample 110 housed in each of the ampoules 100 can be maintained at a temperature without a boil, depending on the degree of evacuation in the airtight chamber 2, until the moisture content of the sample 110 has reached to the desired value.

The sample 110 in each of the ampoules may be frozen. After the moisture content of the frozen sample 110 has reached to the desired value that creates no trouble caused by a boil, the sample 110 may be heated to accelerate drying of the sample.

When the so-called "L-dry" is carried out, the samples 110 housed in the ampoules 100 can be kept at a temperature appropriate to the bacteria contained in the samples 110 until the moisture content of each of the samples 110 has reached to the desired value.

3) Additionally, the airtight chamber 2 can be brought into the desired degree of evacuation by the vacuum pump 3 to lower the moisture content of the samples 110 to the desired value.

4) After that, the ampoules 100 held in the ampoule holder 4 can be transferred to the melt-sealing unit 7 at least one by one by the transfer unit 8, and the ampoules 100 can have the open upper portion melt-sealed in the airtight chamber 2, which is maintained in the atmosphere under the desired degree of evacuation.

5) Additionally, the transfer unit 8 can bring the melt-sealed ampoules 100 back to the ampoule holder 4 to hold the ampoules at the upright position. All ampoules 100 held in the ampoule holder 4 can be sequentially melt-sealed in the airtight chamber 2.

6) After the melt-sealing operation for all ampoules 100 held in the ampoule holder 4 has been completed, the melt-sealed ampoules 100 can be moved together outside the system for storage or another purpose by opening the cover 20 for closing the opening 21 of the airtight chamber 2 and taking out the ampoule holder 4 through the opened opening 21.

Airtight Chamber 2

In the shown example, the airtight chamber 2 is provided on an upper portion of a base 1. The base 1 has the vacuum pump 3 and the temperature controller 9 for controlling the temperature of the stage 5.

By this vacuum pump 3, the inside of the airtight chamber 2 can be maintained in the atmosphere under the desired degree of evacuation.

In the shown example, the temperature controller 9 is provided as a heat exchanger 90, which circulates a coolant or a heat transfer medium through a duct 50 formed in the stage 5 as stated later. By the heat exchanger 90, the stage is put at a desired temperature, and consequently, the ampoule holder 4 put on the stage 5 is put at a desired temperature. Thus, the samples 110 housed in the ampoules 100 held in the ampoule holder 4 can be frozen or thawed, or the temperature of the samples 110 can be kept constant.

In the shown example, the airtight chamber 2 is provided in a box-like casing 22, which comprises an upper surface of the base 1 as a bottom, sidewalls extending along the entire periphery of the base 1, and an upper wall. The box-like casing 22 has a sidewall formed with an open portion, which works as the opening 21 of the airtight chamber 2.

In the shown example, the opening 21 can be openably closed in airtight fashion by the cover 20, which has an upper portion coupled with an upper portion of the box-like casing 22 through a hinge 23.

Ampoule Holder 4

The ampoule holder 4 is made of metal having a good thermal conduction, such as an aluminum alloy, from the viewpoint of effectively making the heat exchange with the stage 5.

In the shown example, the ampoule holder 4 is provided as a board, which has a plurality of holes 40 formed on an upper portion so as to receive the ampoules 100. In the shown example, the ampoule holder 4 has flat upper and lower surfaces, and the ampoule holder is put on the stage 5, having the lower surface in close contact with an upper surface of the stage 5.

In the shown example, the ampoule holder 4 has the holes 40 provided in the upper surface with a regular arrangement in forward, backward, right and left directions at substantially equal distances with respect to adjoining holes 40.

The ampoules 100 can be held together in the upright position by receiving lower portions of the respective ampoules 100 into the respective holes 40 in the ampoule holder 4.

Stage 5

The stage 5 is made of metal having a good thermal conduction, such as an aluminum alloy, from the viewpoint of effectively making the heat exchange with the ampoule holder 5.

In the shown example, the stage 5 is provided as a board, which has a flat upper surface. The stage supports the ampoule holder 4 from below, having the upper surface in close contact with the lower surface of the ampoule holder 4.

The stage 5 includes the duct 50 for the coolant or the heat transfer medium formed therein. In the shown example, The coolant or the heat transfer medium is circulated by the heat exchanger 90 incorporated into the base 1 so that the coolant or the heat transfer medium is fed into the duct 50 from the heat exchanger 90 to make the heat exchange with the stage 5 and is returned to the heat exchanger 90. Thus, the stage 5 can be put at the desired temperature.

The duct 50 typically has one end functioning as a feed-in end for the coolant or the heat transfer medium and the other end functioning as a feed-out end for the coolant or the heat transfer medium. The duct may be formed by a pipe incorporated into the stage 5. The pipe may be bent at plural locations in a zigzag pattern so that the pipe extends repeatedly from one side to the opposite side of the stage, from the opposite side to the one side and from the one side to the opposite side.

As the coolant or the heat transfer medium, alcohol is applicable for instance.

Transfer Unit 8

In the shown example, the ampoules 100, which are held in the ampoule holder 4 put on the stage 5, are sequentially transferred to the melt-sealing unit 7 one by one. The ampoules 100, which have been transferred and melt-sealed at the melt-sealing unit 7, are transferred back to the ampoule holder and are held there at an upright position.

Specifically, in the shown example, the ampoules 100 held in the ampoule holder 4 are, one by one, caught and transferred to the melt-sealing unit 7 by the transfer unit 8. The ampoules 100, which have been melt-sealed at the melt-sealing unit 7, are, one by one, caught and transferred back to the respective original locations of the ampoules 100 in the ampoule holder 4 to be held at the respective original locations by the transfer unit 8.

In the shown example, the transfer unit 8 includes:

1) a stage moving device 80, which linearly reciprocates the stage 5 in a horizontal direction;

2) a head moving device 81, which linearly reciprocates a head 6 above the stage 5 in the horizontal direction and in a direction substantially perpendicular to the moving direction of the stage, the head having a lower end provided with a chuck 60 for an ampoule 100; and 3) a lifting device 82 for the chuck 60, which is provided on the head 6 to move the chuck vertically.

Specifically, in the shown example, the stage 5 is reciprocated in an X-axis direction, the head 6 is reciprocated in a Y-axis direction and the chuck 60 is vertically moved in a Z-axis direction. The melt-sealing unit 7 is provided laterally with respect to the reciprocating direction of the stage 5.

In the shown example, by moving the stage 5, the head 6 and the chuck 60 by use of respective servomotors 80*e*, 81*f* and 82*b*, the head 6 is moved to just above the ampoule 100 at a location in the ampoule holder 4, the chuck 60 is lowered to catch the ampoule 100, the chuck 60 is lifted to take the ampoule 100 out of the ampoule holder 4, and the ampoule 100 is transferred to the melt-sealing unit 7.

After the head 6 is moved to just above the ampoule 100 melt-sealed by the melt-sealing unit 7, the chuck 60 is lowered to catch the ampoule 10, the chuck 60 is lifted, the ampoule 100 is transferred from the melt-sealing unit 7 back to the ampoule holder 4, and the ampoule 100 is held at an upright position in the ampoule holder. In the other words, the ampoule is typically returned to its own original location, where the ampoule has been held.

By repeating the transference to the melt-sealing unit 7, the melt-sealing operation and the transference from the melt-sealing unit 7 to the ampoule holder 4, all ampoules 100 held in the ampoule holder 4 can be melt-sealed.

In the shown example, the stage moving device 80 includes:

1) a groove 80*a*, which is formed on a lower portion of the stager 5;

2) a rail 80*b*, which is provided on the upper surface of the base 1 to guide the stage 5, being engaged with the groove 80*a;*

3) a ball screw 80*c*, which is provided above the base 1 on a lateral side of the rail 80*b* and along the rail 80*b;*

4) a nut 80*d*, which is provided on a lateral side of the stages and has the ball screw 80*c* passing therethrough; and 5) the servomotor 80*e* for driving the ball screw 80*c*.

In the shown example, the head moving device 81 includes:

1) a frame 81*b*, which is horizontally supported by a pole 81*a* extending upright on the upper surface of the base 1;

2) a rail 81*c*, which is provided on the frame 81*b* so as to horizontally extend for guiding the head 6;

3) a ball screw 81*e*, which is provided on the frame 81*b* on a lateral side of the rail 81*c* and along the rail 81*c*, and which passes through a nut 81*d* provided at a position close to the head 6; and 4) the servomotor 81*f*, which is mounted on the frame to drive the ball screw 81*e*.

In the shown example, the lifting device 82 for the chuck 60 includes:

1) a ball screw 82*a*, which is provided on the head 6 so as to have a rotary shaft extending in a vertical direction;

2) the servomotor 82*b*, which is incorporated with the head 6 to drive the ball screw 82*a*; and 3) a nut 82*c*, which is formed in the chuck 60 to pass the ball screw 82*a* therethrough.

In the shown example, the chuck 60 includes:

1) a pair of chuck pieces 61, 61; and 2) a servomotor 62, which drives the paired chuck pieces so as to bring the paired chuck pieces close to or separately from each other.

After the chuck 60 is lowered from above an ampoule to a position to locate the upper portion 101 of the ampoule 100 between the paired chuck pieces 61, 61 with the paired chuck pieces 61, 61 separated, the paired chuck pieces 61, 61 are brought close to each other to sandwich and catch the upper portion 101 of the ampoule 100 therebetween, and the paired chuck pieces are brought separately from each other to release the caught ampoule 100.

Melt-Sealing Unit 7

In the shown example, the melt-sealing unit 7 for an ampoule 100 includes:

1) a holding device 70, which can hold an ampoule 100 transferred by the transfer unit 8 at an upright position with the open upper portion 101 faced upward;

2) a heater 71 for heating the upper portion 101 of an ampoule 100; and 3) a sandwiching and sealing device 72 for the upper portion 101 of a heated ampoule 100;

4) wherein the sandwiching and sealing device 72 is located on lateral sides of the upper portion 101 of the ampoule 100 held in the holding device 70, and the heater 71 is located above the upper portion 101 of the held ampoule 100.

The holding device 70 includes:

1) supporters 70*a*, into each of which an ampoule 100 is inserted from above;

2) urging devices 70*d*, each of which constantly urges its related supporter 70*a*; and 3) an extruding shaft 70*f*, which is pressed against a lower portion of a supporter 70*a* from below so as to be able to upwardly move the supporter 70*a* against the urging action of its related urging device 70*d;*

4) wherein the upper portion 101 of the ampoule 100 is heated by the heater 71 with the related supporter 70*a* pushed up by the extruding shaft 70*f*, the extruding shaft 70*f* ceases to push up the supporter 70*a* after heating, the supporter 70*a* is lowered to its original position by the urging action of the urging device 70*d*, and the upper portion 101 of the heated ampoule 100 is sandwiched and sealed by the sandwiching and sealing device 72.

By this arrangement in the shown example,

1) First, the ampoule 100, which has been transferred to just above a supporter 70*a* by the transfer unit 8, is inserted into the supporter 70*a*, and the ampoule 100 is held in an upright position in the melt-sealing unit 7 by the supporter 70*a* (see FIG. 6).

2) Next, the supporter 70*a* with the ampoule 100 held therein is pushed up by the extruding shaft 70*f*, the upper portion 101 of the ampoule 100 is heated and melted (see FIG. 8), the extruding shaft 70*f* ceases to push up the supporter on completion of the heating and melting operation and allows the supporter 70*a* to be lowered under the urging action of the related urging device 70*d*, and the melted upper portion 101 of the ampoule 100 held by the supporter 70*a* is located at a lateral side of the sandwiching and sealing device 72.

3) Finally, the melted upper portion 101 of the ampoule 100 is smoothly sealed, being sandwiched by the sandwiching and sealing device 72 (FIG. 9).

In the shown example, the heater 71 is provided as a ring-shaped heater 71*a*, which receives an ampoule 100 from below and applies the upper portion of the received ampoule 100 to high-frequency heating. The ring-shaped heater 71*a* is fixed above the base 1.

In the shown example, the sandwiching and sealing unit 72 has the paired sandwiching bars 72*a*, 72*a* incorporated thereinto to be movable so as to be brought close to each other and separately from each other. The paired sandwiching bars 72*a*, 72*a* are, respectively, provided on movable members 72*b*, which include nuts 72*c* carrying on a ball screw 72*d* provided in the horizontal direction and rotated by a servomotor 72*e*. The male threads of the ball screw 72*d* are formed so that one of the movable members 72*b*, on which one of the paired sandwiching bars 72*a*, 72*a* is provided, gets closer to the other movable member 72*b* by a positive rotation of the ball screw 72*d*, and that the other movable member with the other sandwiching bar 72*a* provided thereon gets closer to the one movable member 72*b* by the positive rotation of the ball screw 72*d*. In the other words, the one movable members 72*b* with the one sandwiching bars 72*a* provided thereon gets away from the other movable member 72*b* by the reverse rotation of the ball screw 72*d*, and the other movable member 72*b* with the other sandwiching bar 72*a* provided thereon gets away from the one movable member 72*b* by the reverse rotation of the ball screw 72*d*.

In the shown example, the sandwiching and sealing unit 72 is also fixed above the base 1.

In the shown example, the respective supporters 70*a* forming the holding device 70 are incorporated in respective cylindrical members 70*h* so as to be vertically movable therein and have upper portions formed with receiving holes 70*b* for ampoules 100.

In the shown example, the respective urging devices 70*d*, which constantly urge the respective supporters 70*a*, are configured as helical compression springs 70*e*, which have lower edges pressed against outwardly projecting flanges 70*c* formed on lower portions of the supporters 70*a*, and which have upper edges pressed against inwardly projecting flanges 70*h*' formed on upper portions of the respective cylindrical members 70*h*.

In the shown example, the respective cylindrical members 70*h* have lower portions formed with insertion holes 70*i* for the extruding shaft 70*f*. When the extruding shaft 70*f*, which enters in an insertion hole 70*i* from below, has an upper edge bumped against the lower portion of the related supporter 7*a*, the extruding shaft moves the supporter 70*a* upwardly against the urging action of the related spring.

In the shown example, the extruding shaft 70*f* is configured to be movable from a withdrawal position that the shaft does not enter the insertion hole 70*i* of a cylindrical member 70*h* to a projection position that the shaft enters the insertion hole 70*i*, being controlled by an air cylinder 70*g* incorporated at a lower position than the upper surface of the base 1.

In the shown example, the respective supporters 70*a* forming the holding device 70 are provided at opposite positions on the turntable 73 with respect to the rotary axis of the turntable so that the heater 71 and the sandwiching and sealing device 72 can be located just above one of the paired supporters 70*a*, 70*a*.

In the shown example, the turntable 73 is configured so as to be formed in a long plate-shape and be rotated by a driving shaft 73*a* having the rotary axis in a vertical direction. The rotary shaft 73*a* is configured to be rotated by an air cylinder 73*b* provided below the upper surface of the base 1.

The turntable 73 has both ends provided with the supporters 70*a*. The respective supporters 70*a* are housed in the respective cylindrical members 70*h* and are urged by the respective urging devices 70*d*. The turntable 73 has through holes 73*c* formed therein in communication with the insertion holes 70*i* of the respective cylindrical members 70*h* so that the extruding shaft 70*f* can enter one of the insertion holes 70*i* through the related through hole 70*c*. The distance between one of the paired supporters 70*a*, 70*a* and the rotational center of the turntable 73, and the distance between the other supporter 70*a* and the rotational center of the turntable 73 are set to be substantially equal to each other.

Figure 1:
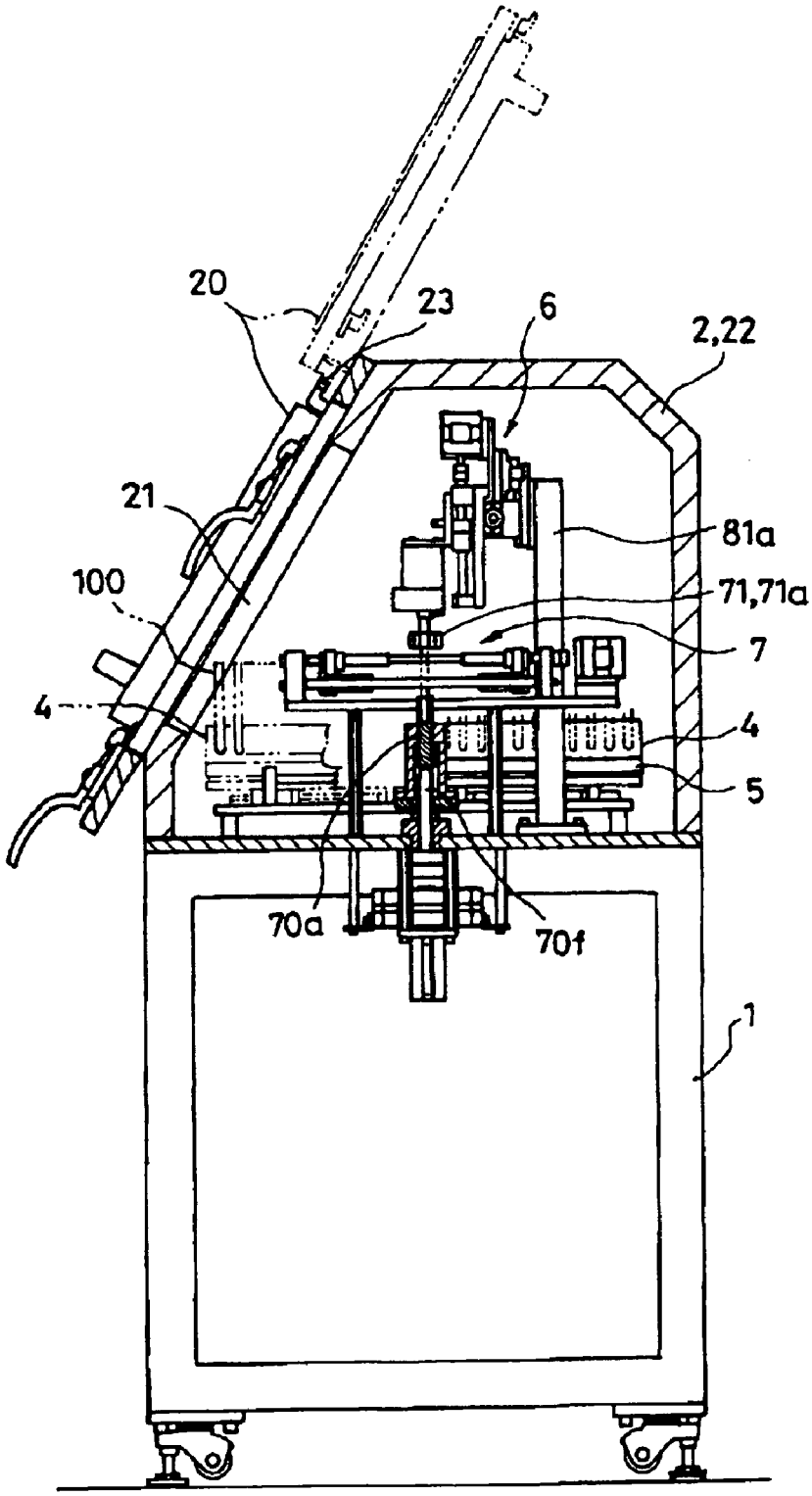
FIG. 1 is a schematic side view of a sealing system according to the present invention.
Figure 2:
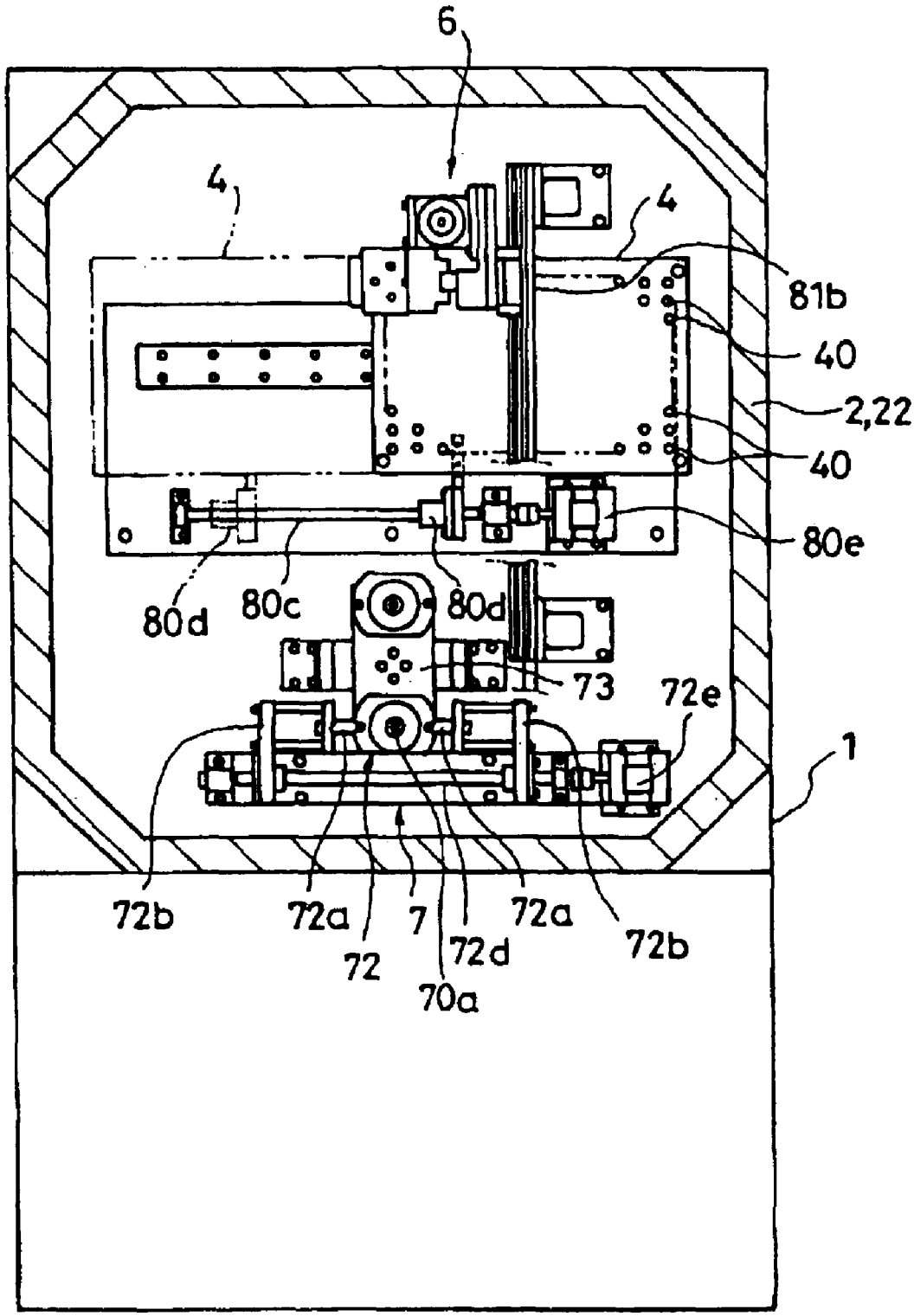
FIG. 2 is a schematic plan view of the sealing system.
Figure 3:
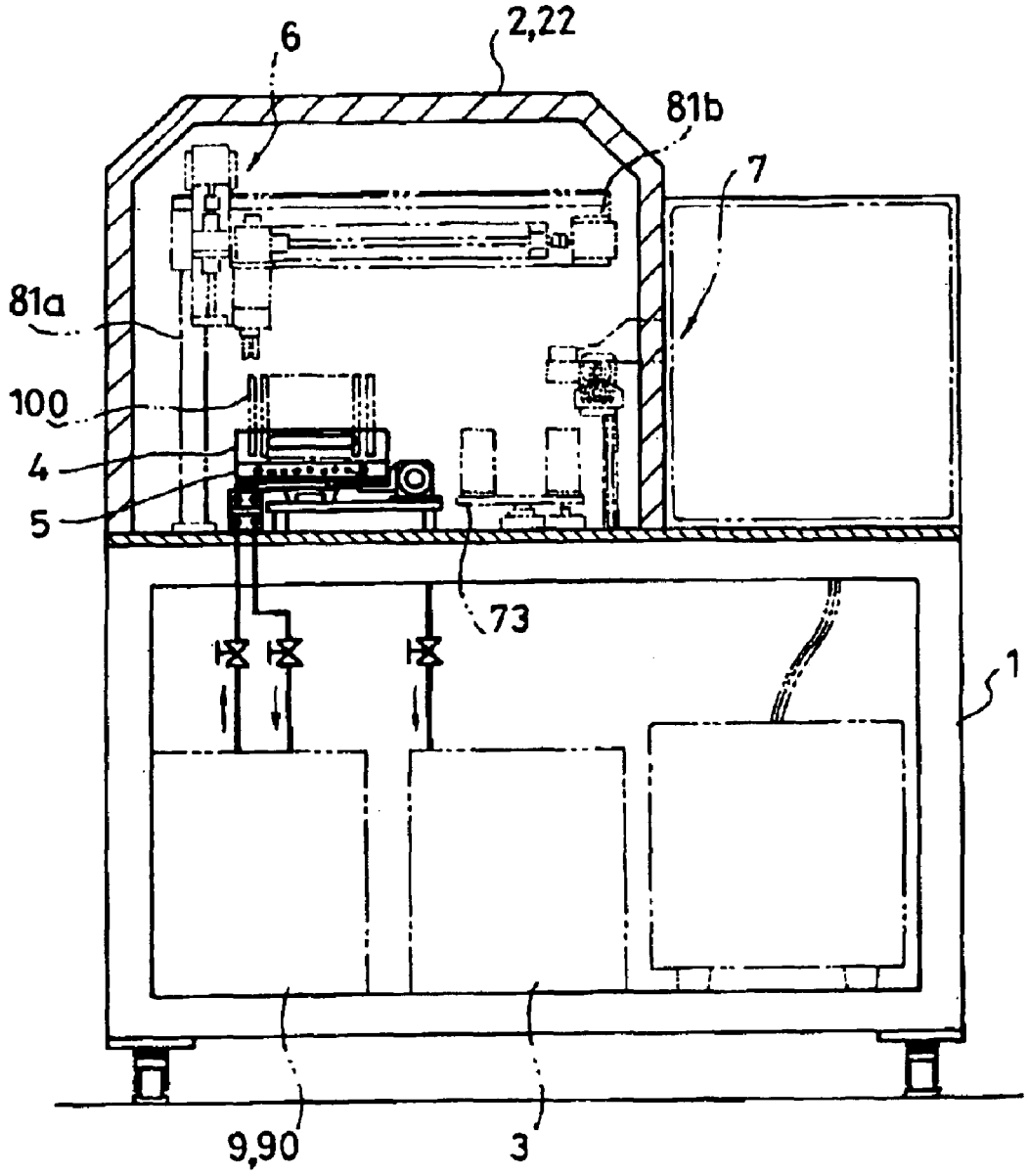
FIG. 3 is a schematic side view of the sealing system (seen in a different direction from FIG. 1)
Figure 4:
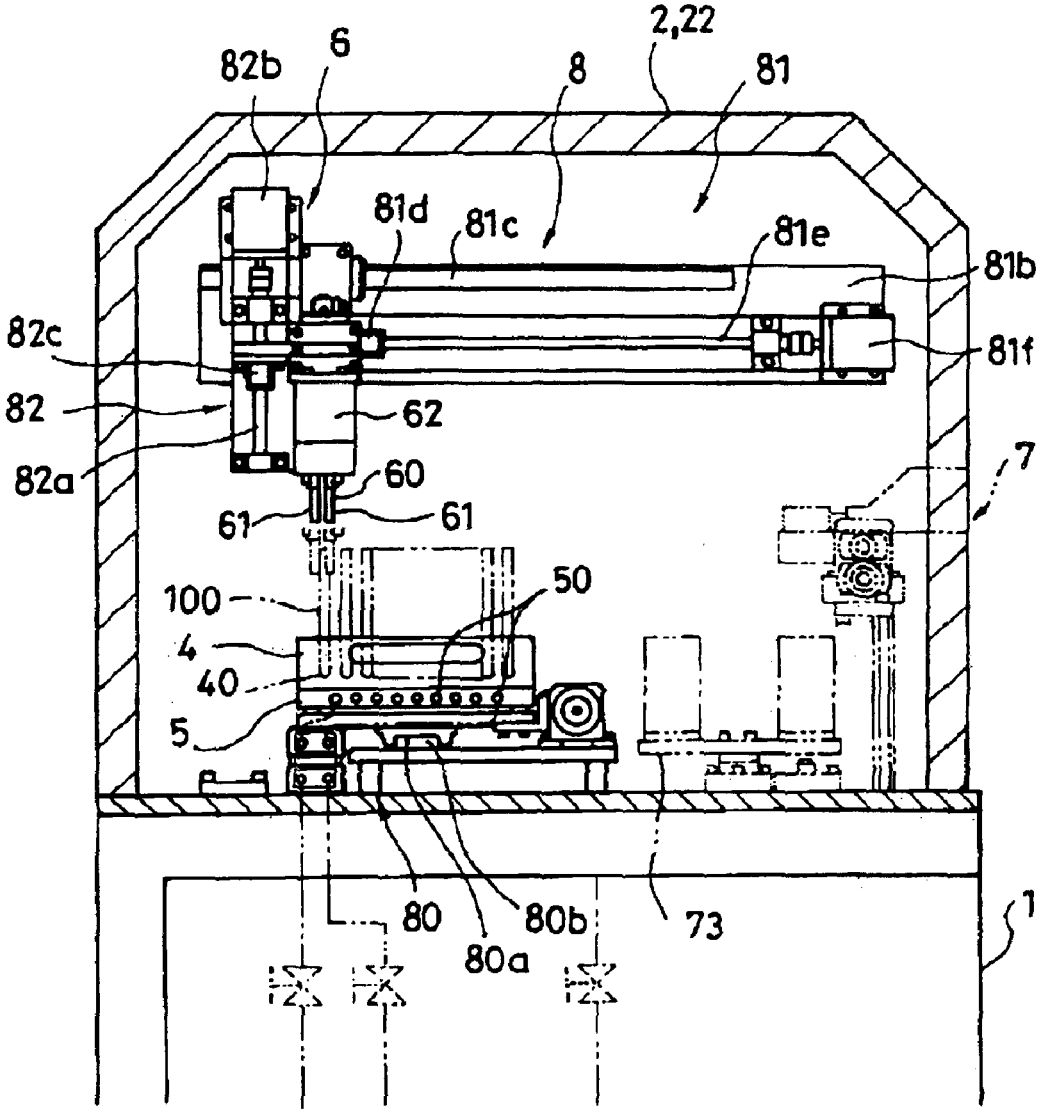
FIG. 4 is a schematic side view of essential parts of the system.
Figure 5:
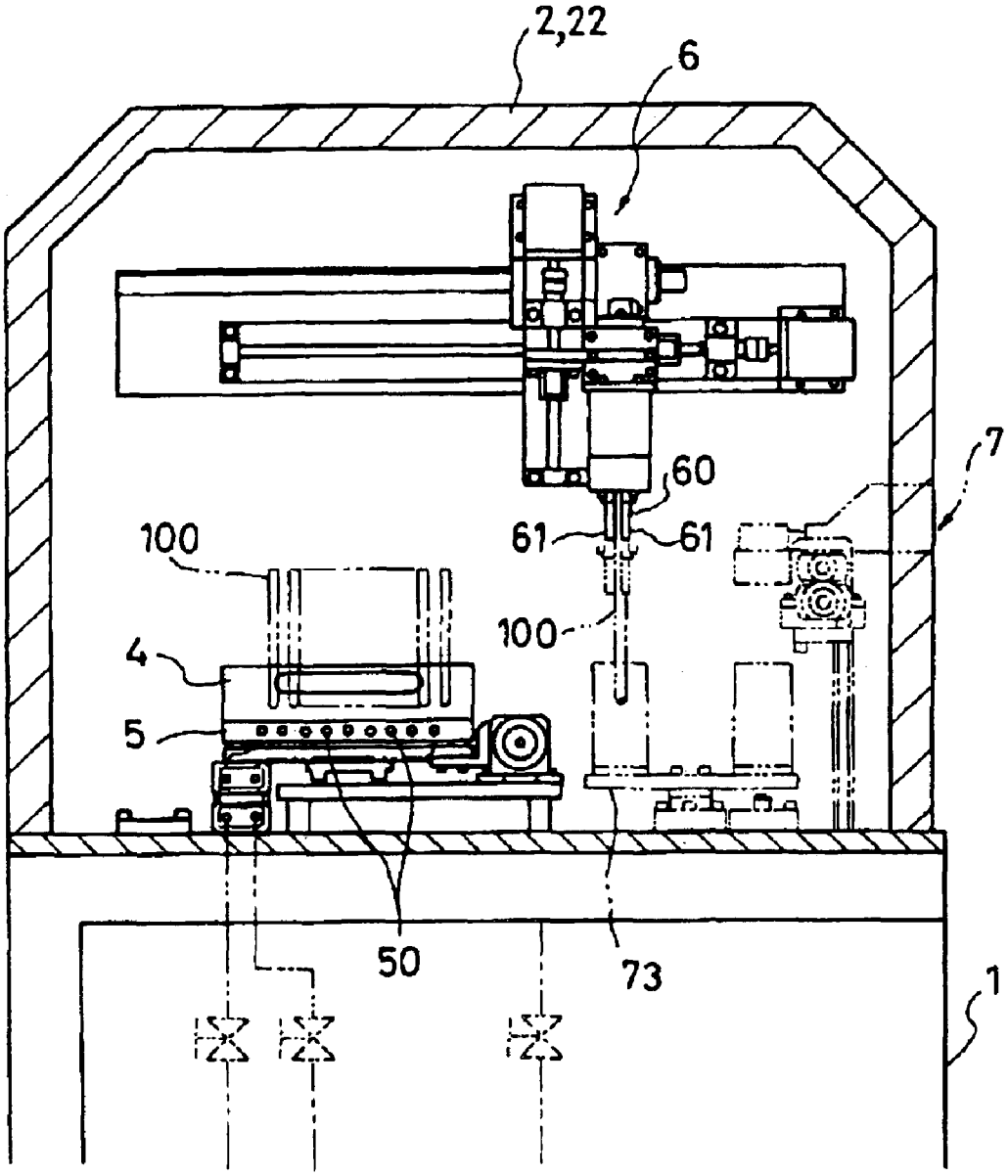
FIG. 5 is a schematic side view of essential parts of the system.

In the arrangement of the shown example, first, one of the paired supporters 70*a*, 70*a* that is not located under the heater 71 and the sandwiching and sealing device 72 receives an unsealed ampoule 100 from the ampoule holder 4 by the transfer unit 8 and holds the unsealed ampoule therein (FIG. 5).

Next, the turntable 73 can be rotated through an angle of 180 degrees to move the unsealed ampoule 100 thus held to a position under the heater 71 and the sandwiching and sealing device 72 (FIG. 6). Then, the supporter 70*a* that holds the unsealed ampoule 100 is pushed up by the extruding shaft 70*f*, and the ampoule is subjected to heating by the heater 71 and sealing by the sandwiching and sealing device 72 (FIGS. 8 and 9).

While the unsealed ampoule 100 is being subjected to the heating operation and the sealing operation as stated earlier, another unsealed ampoule 100 to be next melt-sealed is transferred from the ampoule holder 4 by the transfer unit 8 and is held in the supporter 70*a* that is not located under the heater 71 and the sandwiching and sealing device 72.

At the timing when the melt-sealing operation for the first ampoule 100 to be melt-sealed at a first place has been completed, the turntable 73 can be rotated through an angle of 180 degrees again to move the second unsealed ampoule 100 to be melt-sealed at a second place to the position under the heater 71 and the sandwiching and sealing device 72 and also to move the first melt-sealed ampoule 100 to the position that is not located under the heater 71 and the sandwiching and sealing device 72.

While the second unsealed ampoule 100 at the second place is being subjected to the heating operation and the sealing operation as stated earlier, the first melt-sealed ampoule 100 thus moved is transferred to the ampoule holder 4 by the transfer unit 8 to be held there again, and another unsealed ampoule 100 to be melt-sealed at a third place is transferred from the ampoule holder 4 by the transfer unit 8 and is held in the supporter 70*a* that has the first melt-sealed ampoule 100 removed therefrom.

In other words, in the shown example, making use of the time period where the second unsealed ampoule 100 at the second place is being subjected to the heating operation and the sealing operation, the turntable 73 can carry out the move of the melt-sealed ampoule 100 at the first place to the ampoule holder 4 and the move of the unsealed ampoule 100 to be melt-sealed at the third place toward the melt-sealing unit 7, effectively melt-sealing the plural ampoules 100.

By the system for melt-sealing, in dry fashion, glass ampoules with a sample housed therein according to the present invention, it is possible to sequentially and properly melt-seal a plurality of glass ampoules with a microorganism containing sample housed therein, at a desired temperature and in an atmosphere under a desired degree of evacuation.

What is claimed is:

1. A system configured to seal at least one ampoule of a plurality of ampoules with a sample housed therein, in dry fashion, which is capable of melt-sealing glass ampoules with a microorganism containing sample housed therein with the ampoules put at a desired temperature and in an atmosphere under a desired degree of evacuation so that the sample has a moisture content thereof lowered in the atmosphere, the system comprising:

an airtight chamber defining an opening configured to be airtightly closable by a cover; and a vacuum pump configured to bring the airtight chamber into the atmosphere under the desired degree of evacuation;

wherein the airtight chamber comprises:

an ampoule holder configured to hold the ampoules in an upright position so that open upper portions of the ampoules face upward;

a stage, on which the ampoule holder is disposed;

a melt-sealing unit configured to melt-seal the ampoule;

a transfer unit configured to grasp the ampoule held in the ampoule holder and to transfer the ampoule to the melt-sealing unit, and configured to grasp the ampoule melt-sealed at the melt-sealing unit and to transfer the melt-sealed ampoule to the ampoule holder to be held therein; and a temperature controller configured to control the temperature of the stage.

2. The system according to claim 1, wherein the ampoule holder comprises a board defining a plurality of holes on an upper portion configured to receive the ampoules.

3. The system according to claim 1, wherein the stage comprises a duct configured to receive a coolant or a heat transfer medium, and wherein the system further comprises:

a heat exchanger configured to circulate the coolant or the heat transfer medium through the duct.

4. The system according to claim 1, wherein the transfer unit comprises:

a stage moving device configured to linearly reciprocate the stage in a horizontal direction;

a head moving device configured to linearly reciprocate a head above the stage in the horizontal direction and in a direction substantially perpendicular to a moving direction of the stage, the head comprising a chuck configured to grasp the ampoule; and a lifting device disposed on the head configured to move the chuck in a vertical direction.

5. The system according to claim 1, wherein the melt-sealing unit comprises:

a holding device configured to hold the ampoule transferred by the transfer unit at an upright position with the open upper portion faced upward;

a heater configured to heat the upper portion of the ampoule; and a sealing device configured to seal the upper portion of the heated ampoule;

wherein the sealing device is configured to be disposed on a side of the upper portion of the ampoule disposed in the holding device, and the heater is configured to be disposed above the upper portion of the held ampoule;

wherein the holding device comprises:

a supporter configured to receive the ampoule from above;

an urging device configured to constantly urges the supporter; and an extruding shaft configured to press against a lower portion of the supporter from below to upwardly move the supporter against an urging action of the urging device; and wherein the system is configured such that the upper portion of the ampoule is heated by the heater with the supporter pushed up by the extruding shaft, the extruding shaft ceases to push up the supporter after heating, the supporter is lowered to its original position by the urging action of the urging device, and the upper portion of the heated ampoule is sealed by the sealing device.

6. The system according to claim 5, wherein the holding device comprises supporters disposed at opposite positions on a turntable with respect to a rotary shaft of the turntable configured so that the heater and the sealing device is disposed above one of the supporters.

* * * * *